US011609065B2

(12) United States Patent
Raymond

(10) Patent No.: US 11,609,065 B2
(45) Date of Patent: Mar. 21, 2023

(54) MULTI-ADJUSTABLE FIREARM STOCK

(71) Applicant: Charles C. Raymond, St. Clair, MI (US)

(72) Inventor: Charles C. Raymond, St. Clair, MI (US)

(73) Assignee: Charles Raymond, St. Clair, MI (US)

( * ) Notice: Subject to any disclaimer, the term of this patent is extended or adjusted under 35 U.S.C. 154(b) by 54 days.

(21) Appl. No.: 17/176,639

(22) Filed: Feb. 16, 2021

(65) Prior Publication Data

US 2021/0254928 A1 Aug. 19, 2021

Related U.S. Application Data

(60) Provisional application No. 62/995,759, filed on Feb. 13, 2020.

(51) Int. Cl.
*F41C 23/14* (2006.01)
*F41C 23/04* (2006.01)
*F41C 23/20* (2006.01)

(52) U.S. Cl.
CPC ..... *F41C 23/04* (2013.01); *F41C 23/20* (2013.01)

(58) Field of Classification Search
CPC ..... F41C 23/04; F41C 23/20; F41C 23/14; F41A 11/04
USPC ..... 42/75.03, 73, 71.01
See application file for complete search history.

(56) References Cited

U.S. PATENT DOCUMENTS 762,862 A * 6/1904 Phillips ..... F41C 23/12 42/72
5,924,233 A * 7/1999 Strobel ..... F41C 23/22 42/72
7,398,616 B1 * 7/2008 Weir ..... F41C 23/20 42/72
8,720,099 B1 * 5/2014 Sisk ..... F41C 23/14 42/73
8,984,791 B1 * 3/2015 Leslie ..... F41C 23/04 42/71.01
9,207,042 B1 * 12/2015 Erskine ..... F41A 19/03
9,488,435 B1 * 11/2016 Roberts ..... F41C 23/14
9,562,740 B1 * 2/2017 Korliker ..... F41C 23/14
2002/0050088 A1 * 5/2002 Sharp ..... F41C 23/04 42/73
2009/0282718 A1 * 11/2009 Bartley ..... F41C 23/12 42/75.03
2010/0242328 A1 * 9/2010 Faifer ..... F41C 23/06 42/1.06
2011/0283585 A1 * 11/2011 Cabahug ..... F41G 11/003 42/73

(Continued)

*Primary Examiner* — Michael D David
(74) *Attorney, Agent, or Firm* — Quinn IP Law

(57) ABSTRACT

A stock assembly for use with a firearm includes a stock assembly body having a forward end, an opposing rear end, and a bottom portion defined between the forward end and rear end. A locking mechanism may be disposed on the stock assembly body. A rear butt member may be adjustably positionable on the rear end of the stock assembly body and include a housing defining an end surface forming a base region and a protruding region extending from the base region. The rear butt member may be adjustably positionable relative to the stock assembly body to position the rear butt member base region on a surface extending forward of a user and the protruding region proximate the user for operation of the firearm by the user.

16 Claims, 13 Drawing Sheets

(56) References Cited

U.S. PATENT DOCUMENTS

| | | | | |
|---|---|---|---|---|
| 2012/0260552 | A1* | 10/2012 | Vesligaj | F41C 23/06<br>42/1.06 |
| 2013/0097911 | A1* | 4/2013 | Larue | F41C 23/04<br>42/73 |
| 2015/0176944 | A1* | 6/2015 | Kupanoff | F41C 23/12<br>42/73 |
| 2015/0276343 | A1* | 10/2015 | Zusman | F41C 23/22<br>42/71.01 |
| 2016/0273875 | A1* | 9/2016 | Cottle | F41C 23/14 |
| 2017/0059271 | A1* | 3/2017 | Bowen | F41C 23/04 |
| 2017/0205187 | A1* | 7/2017 | Brown | F41C 23/10 |
| 2017/0356718 | A1* | 12/2017 | Johnson | F41C 23/20 |
| 2018/0003459 | A1* | 1/2018 | Miller | B21D 22/00 |
| 2019/0154397 | A1* | 5/2019 | Holloway, II | F41C 33/0263 |
| 2019/0204044 | A1* | 7/2019 | Overstreet | F41C 23/14 |
| 2020/0141689 | A1* | 5/2020 | Underwood | F41C 23/14 |
| 2020/0200505 | A1* | 6/2020 | Brown, Jr. | F41C 27/00 |
| 2021/0018296 | A1* | 1/2021 | Faifer | F41C 23/14 |
| 2021/0239423 | A1* | 8/2021 | Liptak | F41C 23/12 |
| 2021/0254928 | A1* | 8/2021 | Raymond | F41C 23/20 |
| 2021/0372731 | A1* | 12/2021 | Shinkle | F41C 23/14 |
| 2022/0228837 | A1* | 7/2022 | Bray | F41C 23/14 |

* cited by examiner

MULTI-ADJUSTABLE FIREARM STOCK

CROSS REFERENCE TO RELATED APPLICATIONS

This application claims the benefit of U.S. Provisional Patent Application No. 62/995,759, entitled "MULTI-ADJUSTABLE FIREARM STOCK" filed on Feb. 13, 2020, which is incorporated by reference in its entirety in this disclosure.

INTRODUCTION

This disclosure relates to an adjustably positionable stock assembly for a firearm.

Soldiers often shoot while wearing bulky garments, body armor, or accessories like load bearing gear. Shooting a rifle while wearing bulky clothing or equipment is notoriously complicated and can become a burden during dangerous combat environments. There is a constant demand to develop or include features to help stabilize the weapon buttstock in the shoulder pocket of the armor vest.

Due to the flaws of prior designs, it is a goal of the present disclosure to provide an improved and simplified firearm stock that can be used in various shooting positions, including but not limited to, the traditional upright shooting position, a combative hunched shooting position, and a prone shooting position, all while wearing body armor and/or broad shoulder straps. A second goal of the present disclosure is to provide an improved firearm stock with an adjustable butt pad feature where the user can adjust the contour angle of the butt pad according to their own personal preference.

SUMMARY

A firearm includes a receiver, a barrel assembly connected to a forward end of the receiver and a receiver extension tube connected to a rear end of the receiver. A stock assembly releasably engages the receiver extension tube. The stock assembly may include a stock assembly body having a forward end, an opposing rear end, and a bottom portion defined between the forward end and rear end. A locking mechanism may be disposed on the stock assembly body and configured to releasably engage a portion of an outer surface of the receiver extension tube.

A rear butt member may be adjustably positionable on the rear end of the stock assembly body. The rear butt member may include a housing defining an end surface forming a base region and a protruding region extending from the base region. The rear butt member may be adjustably positionable relative to the stock assembly body to position the rear butt member base region on a surface extending forward of a user and the protruding region proximate the user for operation of the firearm by the user.

The stock assembly may include an outer periphery and an inner periphery having at least one channel configured to receive and releasably engage a portion of an outer surface of the receiver extension tube, wherein the stock assembly is adjustably positionable axially along a longitudinal axis of the receiver extension tube.

The bottom portion of the stock assembly body may include a first region disposed adjacent the forward end of the body, an opposing second region disposed adjacent to and terminating at the rear end of the body, and a contoured region formed between the first portion and second portion of the body, wherein the contoured region is a recessed area formed in the bottom portion of the body that is sized to accommodate an external accessory of the user. The contoured region of the bottom portion of the stock assembly body may be at least partially concave shaped relative to the first region and the second region inward toward the longitudinal axis of the receiver extension tube.

The locking mechanism may include a bracket cooperating with a receiving surface of the stock assembly body, a handle movably connected to the bracket, wherein the handle includes a mating recess receiving one or more springs therein and a latching member received in the mating recess of the handle and extending through the bracket into the inner periphery of the stock assembly body. The latching member may be positionable between the first position to releasably engage the outer surface of the receiver extension tube and a second position wherein the latching member disengages the outer surface of the receiver extension tube to position the stock assembly along the longitudinal axis of the receiver extension tube. The handle may be shaped to align with the shape of the bottom portion of the stock assembly body and includes one or more apertures formed therein.

A mounting surface may be provided on the rear end of the stock assembly body. A plate cooperates with the housing of the rear butt member adjustably connected to the mounting surface. The mounting surface and plate cooperate to adjustably position the rear butt member to the stock assembly body. A plurality of recesses may be formed in the end surface of the housing of the rear butt member.

A stock assembly for use with a firearm includes a stock assembly body having a forward end, an opposing rear end, and a bottom portion defined between the forward end and rear end. The bottom portion of the stock assembly body may include a first region disposed adjacent the forward end of the body, an opposing second region disposed adjacent to and terminating at the rear end of the body, and a contoured region formed between the first portion and second portion of the body. A locking mechanism may be disposed on the stock assembly body. The locking mechanism may be configured to releasably engage a portion of an outer surface of a receiver extension tube of the firearm.

A rear butt member may be adjustably positionable on the rear end of the stock assembly body. The rear butt member may include a housing defining an end surface forming a base region and a protruding region extending from the base region. The rear butt member may be adjustably positionable relative to the stock assembly body to position the rear butt member base region on a surface extending forward of a user and the protruding region proximate the user for operation of the firearm by the user.

The stock assembly body may include an outer periphery and an inner periphery having at least one channel configured to receive and releasably engage a portion of an outer surface of the receiver extension tube of the firearm. The stock assembly may be adjustably positionable axially along a longitudinal axis of the receiver extension tube.

The bottom portion of the stock assembly body may include a first region disposed adjacent the forward end of the body, an opposing second region disposed adjacent to and terminating at the rear end of the body, and a contoured region formed between the first portion and second portion of the body. The contoured region may be a recessed area formed in the bottom portion of the body that may be sized to accommodate an external accessory of the user. The contoured region of the bottom portion of the stock assembly body may be at least partially concave shaped relative to the first region and the second region inward toward the longitudinal axis of the receiver extension tube.

The locking mechanism may include a bracket cooperating with a receiving surface of the stock assembly body, a handle movably connected to the bracket, wherein the handle includes a mating recess receiving one or more springs therein and a latching member received in the mating recess of the handle and extending through the bracket into the inner periphery of the stock assembly body. The latching member may be positionable between the first position to releasably engage the outer surface of the receiver extension tube and a second position wherein the latching member disengages the outer surface of the receiver extension tube to position the stock assembly along the longitudinal axis of the receiver extension tube.

The handle may be shaped to align with the shape of the bottom portion of the stock assembly body and include one or more apertures formed therein. A mounting surface may be provided on the rear end of the stock assembly body. A plate cooperating with the housing of the rear butt member may be adjustably connected to the mounting surface. The mounting surface and plate may cooperate to adjustably position the rear butt member to the stock assembly body. A plurality of recesses may be formed in the end surface of the housing of the rear butt member.

A stock assembly for use with a firearm includes a stock assembly body defining an inner periphery including at least one channel, an outer periphery, a forward end, and an opposing rear end. A locking mechanism may be disposed on the stock assembly body. The locking mechanism may be configured to releasably engage a portion of an outer surface of a receiver extension tube of the firearm. A rear butt member may be formed on the rear end of the body.

One or more adjustably positionable arms may be disposed on the outer periphery of the stock assembly body. The one or more arms may be positionable between a stored position adjacent the outer periphery of the stock assembly body and a deployed position wherein the one or more arms extends rearward of the rear end of the body and the rear butt member proximate a user for operation of the firearm by the user.

The outer periphery of the stock assembly body may include at least one channel disposed proximate the rear end of the body sized to at least partially receive and engage the one or more adjustably positionable arms. The one or more arms may be positioned proximate the outer periphery of the stock assembly body in the at least one channel such that no portion of the one or more arms extends rearward of the rear end of the body and rear butt member in the stored position and at least one of the arms may be adjustably positioned through the channel to extend rearward of the rear end of the body and the rear butt member in the deployed position.

The outer periphery of the stock assembly body may include at least one recess disposed proximate the rear end of the body sized to at least partially receive the one or more adjustably positionable arms. The one or more arms may be pivotally connected to the outer periphery of the body and received within the at least one recess proximate the outer periphery of the stock assembly body such that no portion of the one or more arms extends rearward of the rear end of the body and rear butt member in the stored position and at least one of the arms may be rotated to extend rearward of the rear end of the body and the rear butt member in the deployed position.

The outer periphery of the stock assembly body wherein one or more adjustably positionable arms may be rotatably connected to the outer periphery of the body. The one or more arms may be positioned proximate the outer periphery of the stock assembly body such that no portion of the one or more arms extends rearward of the rear end of the body and rear butt member in the stored position and at least one of the arms may be rotated to extend rearward of the rear end of the body and the rear butt member in the deployed position.

The above features and advantages, and other features and advantages, of the present disclosure are readily apparent from the following detailed description of some of the best modes and other embodiments for carrying out the disclosure, as defined in the appended claims, when taken in connection with the accompanying drawings.

DETAILED DESCRIPTION

Figure 1:
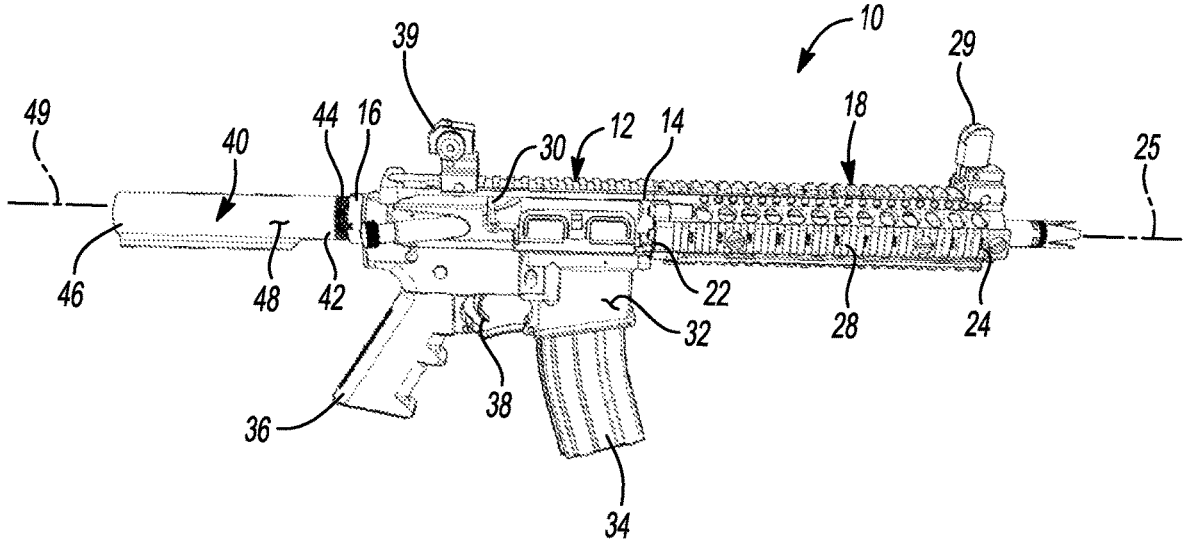
FIG. 1 is an isometric view of an exemplary firearm.

Reference will now be made in detail to several embodiments of the disclosure that are illustrated in accompanying drawings. Whenever possible, the same or similar reference numerals are used in the drawings and the description to refer to the same or like parts or steps. The drawings are in simplified form and are not to precise scale. For purposes of convenience and clarity, directional terms such as top, bottom, left, right, up, over, above, below, beneath, rear, and front, may be used with respect to the drawings. These and similar directional terms are not to be construed to limit the scope of the disclosure.

The components of the disclosed embodiments, as generally described and illustrated in the Figures herein, could be arranged and designed in a wide variety of different configurations. Thus, the following detailed description of the embodiments of the disclosure is not intended to limit the scope of the disclosure, as claimed, but is merely representative of possible embodiments of the disclosure.

In addition, while numerous specific details are set forth in the following description to provide a thorough understanding of the embodiments disclosed herein, some embodiments may be practiced without some or all these details. Moreover, for the purpose of clarity, certain technical material in the related art has not been described in detail to avoid unnecessarily obscuring the disclosure.

Figure 2:
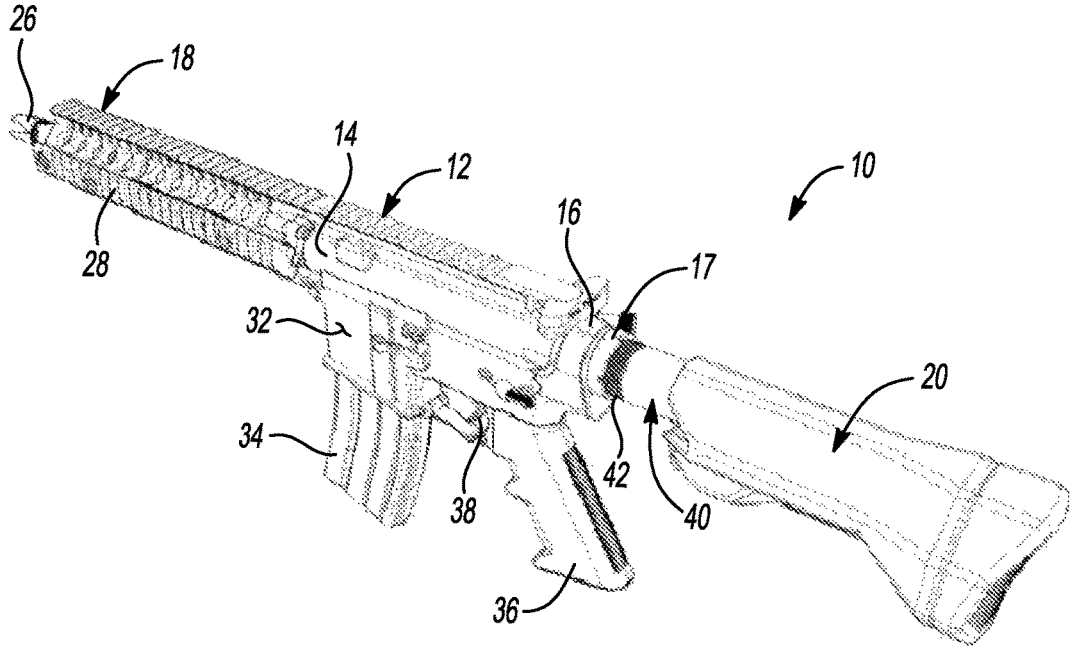
FIG. 2 is a perspective view of one embodiment of an adjustably positionable firearm stock assembly disposed on a firearm in accordance with embodiments of the disclosure.

Referring to the drawings, wherein like reference numbers correspond to like or similar components throughout the several Figures, FIGS. 1 and 2 illustrate a firearm 10, consistent with embodiments disclosed herein. The firearm 10 is configured as illustrated in FIG. 1 for exemplary purposes in a rifle configuration. It is understood that the present embodiments may be used with firearms such as, but not limited to, rifles, semi-automatic rifles, shotguns, hunting rifles and the like. The firearm 10 includes a body or receiver 12 having a first or front end 14 and an opposing second or rear end 16.

A barrel assembly 18 is connected to and extends forward of the front end 14 of the receiver 12. A stock assembly 20 is removably mounted to and extends rearwardly of the rear end 16 of the receiver 12. It is understood that a variety of barrel configurations may be utilized with firearm 10. The barrel assembly 18 is configured as shown in FIGS. 1 and 2 for illustrative purposes and generally includes a rear portion 22 removably mounted to the front end 14 of the receiver 12 and a forward portion 24 incorporating a muzzle 26. A longitudinal axis 25 is defined by the barrel assembly 18 and extends between the forward portion 24 and rear portion 22.

A handguard 28 extends at least partially between the rear portion 22 and forward portion 24 of the barrel assembly 18. The barrel assembly 18 may incorporate other firearm components, including, but not limited to, a forward sight 29 disposed on an upper portion of the barrel assembly 18 and an auxiliary handle (not shown) mounted to a lower portion of the barrel assembly 18.

The receiver 12 of firearm 10 may be a unitary structure or include multiple cooperating components, such as a mating arrangement between an upper receiver body and a lower receiver body, wherein the upper receiver body cooperates with the barrel assembly 18 and the mated lower receiver body cooperates with the stock assembly 20. The receiver 12 includes a bolt and bolt carrier assembly, generally referenced by number 30. The bolt and bolt carrier assembly 30 is aligned with the longitudinal axis 25 of the barrel assembly 18.

An ammunition well 32 formed in the receiver 12 adjacent the front end 14 cooperates with the bolt and bolt carrier assembly 30. A magazine 34 is removably connected to an ammunition well 32 in the receiver 12 adjacent the front end 14. The magazine 34 receives and supplies ammunition (not shown) through the ammunition well 32 in the receiver 12 to the bolt and bolt carrier assembly 30 for use by the firearm 10. The receiver 12 further includes a handle 36 disposed in a lower portion of the receiver 12 adjacent the rear end 16 of the receiver 12. A trigger 38 of a firing mechanism (not shown) is disposed forward of the handle 36 in the receiver 12. A rear sight 39 is disposed on an upper portion of the receiver 12 that may cooperate with the forward sight 29 on the barrel assembly 18 or be used independently with firearm 10.

Referring now to FIG. 1, the firearm 10 may include metal frame, a buffer tube or receiver extension tube 40 removably connected adjacent the rear end 16 of the receiver 12. The receiver extension tube 40 includes a first end 42 incorporating a connecting portion 44, an opposing second end 46 and an outer surface 48 of the tube 40 defined between the first end 42 and second end 46 of the receiver extension tube 40. The connecting portion 44 on the first end 42 of the receiver extension tube 40 may be configured to engage a mating portion 17 on the rear end 16 of the receiver 12. A longitudinal axis 49 extends generally between the first end 42 and second end 44 of the receiver extension tube 40. It is contemplated that the longitudinal axis 49 may align with the longitudinal axis 25 of the barrel assembly 18 and the bolt and bolt carrier assembly 30.

Referring now to FIGS. 2-8 and 9A-9B, embodiments of an adjustably positionable stock assembly 20 are illustrated and described in greater detail. The stock assembly 20 generally includes a body 50 defining an outer periphery 52 and an inner periphery 54. The stock assembly body 50 may be formed using a plastic material, polymeric material, a metallic material, a wood material and/or a combination of plastic, polymeric, metallic, and wood materials for functional and aesthetic purposes. The body 50 may be formed from the various materials described above as a unitary structure or as a multiple piece structure with mating portions that are secured together to create the body 50 of stock assembly 20.

The inner periphery 54 may include at least one channel 56 defined in a forward end 58 of the body 50. The at least one channel 56 of the inner periphery 54 may be configured to receive and releasably engage a portion of the outer surface 48 of the receiver extension tube 40 and allow the stock assembly 20 to be adjustably positionable axially along the longitudinal axis 49 of the receiver extension tube 40. The rearward or rear end 60 of body 50 is provided opposite the forward end 58 on body 50 and may be configured to receive a rear butt pad or member 90.

Figure 3:
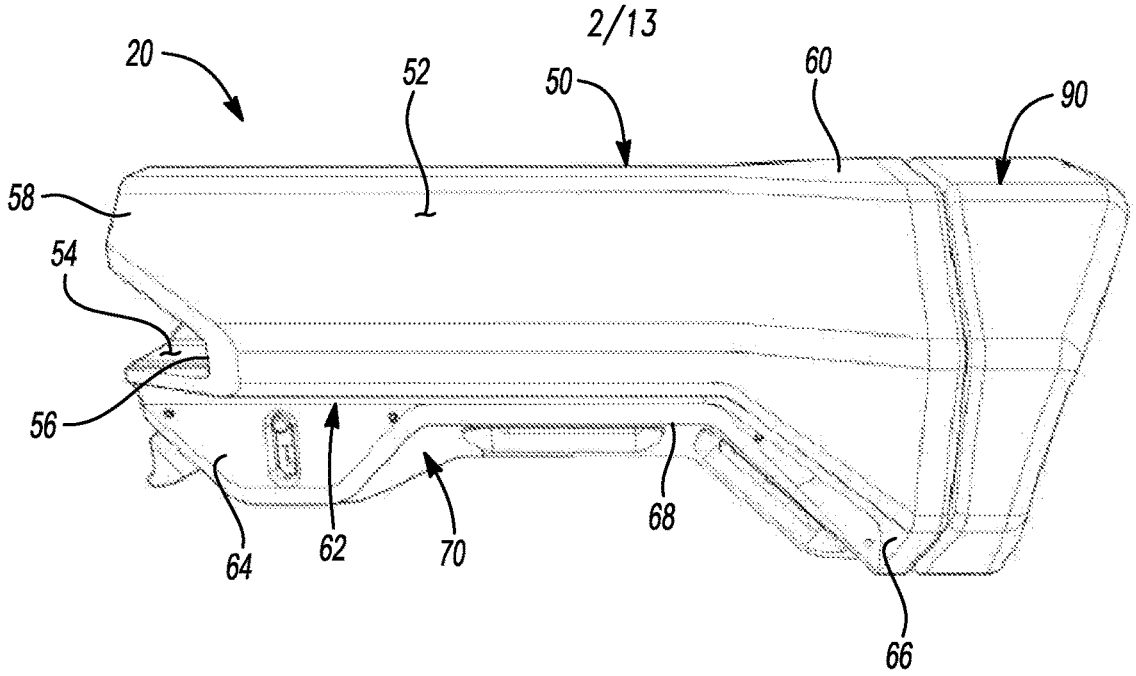
FIG. 3 is a side view of one embodiment of the adjustably positionable firearm stock assembly.
Figure 7:
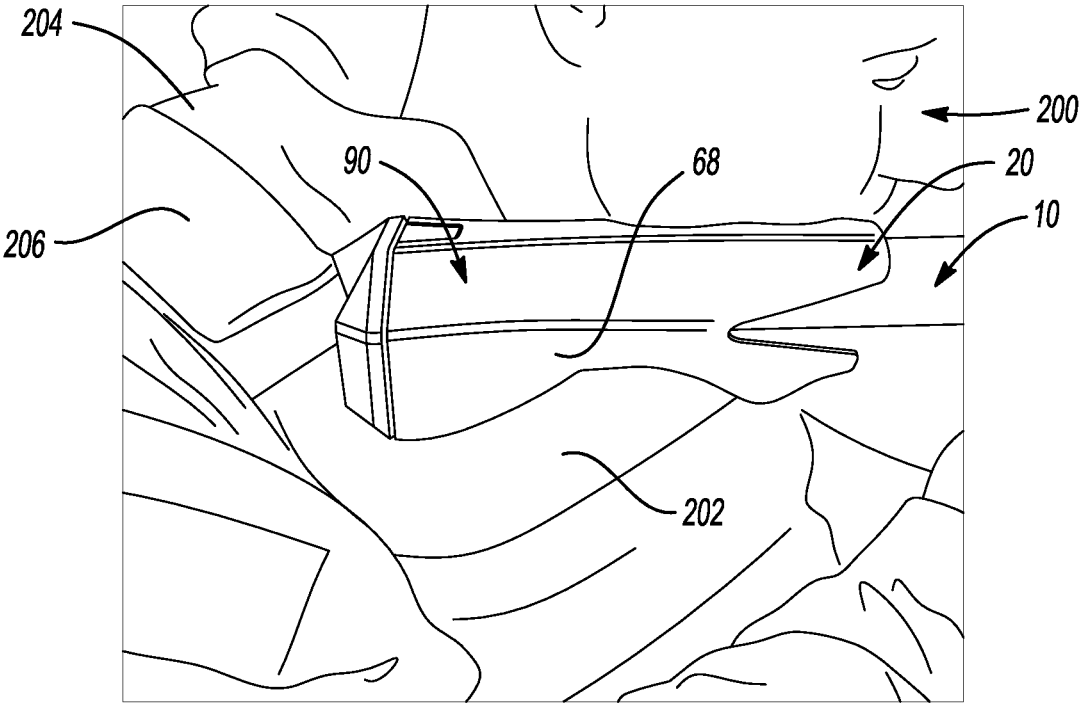
FIG. 7 is a perspective view of a user engaging the adjustably positionable firearm stock assembly in accordance with embodiments of the disclosure.

As is best illustrated in FIGS. 3 and 7, a bottom portion 62 of the stock assembly body 50 includes a first region 64 disposed adjacent the forward end 58 of the body 50 and an opposing second region 66 disposed adjacent to and terminating at the rear end 60 of the body 50. The bottom portion 62 further includes a contoured region 68 formed between the first portion 64 and second portion 66 of the body 50. In one or more embodiments, the contoured region 68 is a recessed area formed in the bottom portion 62 of the body 50 relative to the first region 64 and second region 66 of the bottom portion.

Figure 8:
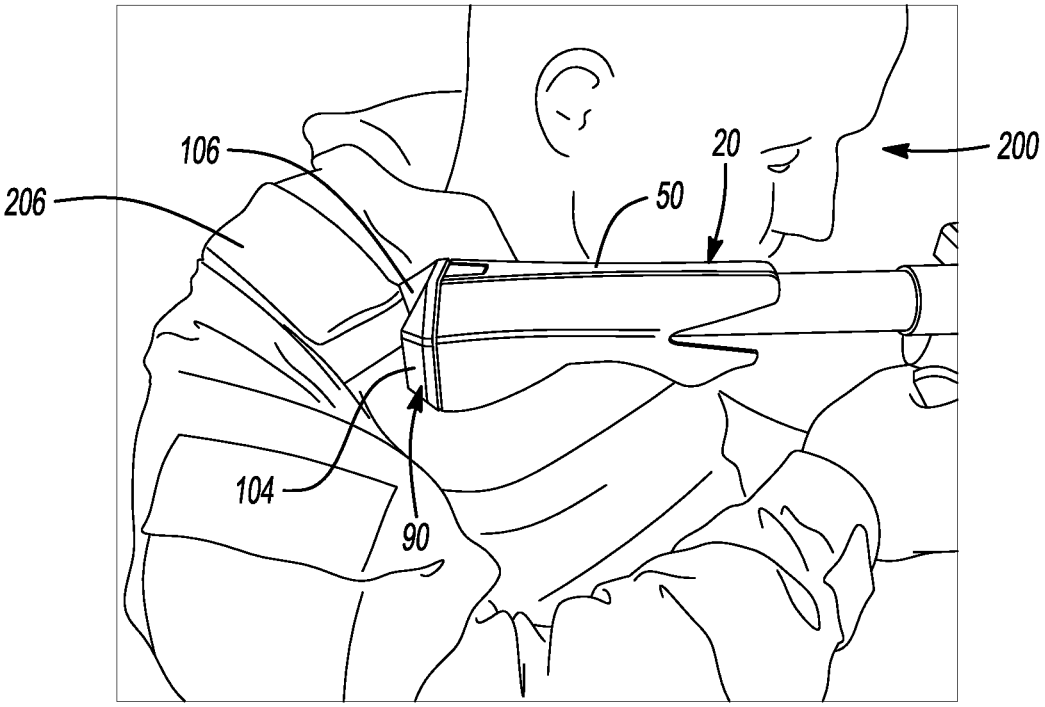
FIG. 8 is a perspective view of a user engaging the adjustably positionable firearm stock assembly in accordance with embodiments of the disclosure.

As illustrated in FIGS. 3, 7 and 8, the recessed contoured region 68 of the bottom portion 62 of the body is sized to accommodate an external garment or accessory of a user, such as body armor, generally referenced by number 202, of an operator or user 200 of the firearm 10, when the firearm 10 is positioned by the user 200 in an operating or firing position. A user's body armor 202 may move upward toward the user's 200 upper torso and head when the firearm is aimed and/or operated. The contoured region 68 of the body 50 of stock assembly 20 permits user 200 to position the stock assembly 20 in the firing position wherein the stock assembly 20 is positioned adjacent the user's 200 shoulder and face.

It is understood that the contoured region 68 of the bottom portion 62 of the stock assembly body 50 may include a variety of geometries or configurations. In one non-limiting example shown in the side view of the stock assembly of FIG. 3, the contoured region 68 may be at least partially concave shaped relative to the first region 64 and second region 66 such that the contoured region 68 curves inward toward the longitudinal axis 49 of the stock assembly 20. However, it is understood that other geometries and configurations may be utilized for the contoured region, such as the multiple contoured regions 68, 69 illustrated in FIG. 12.

Figure 4:
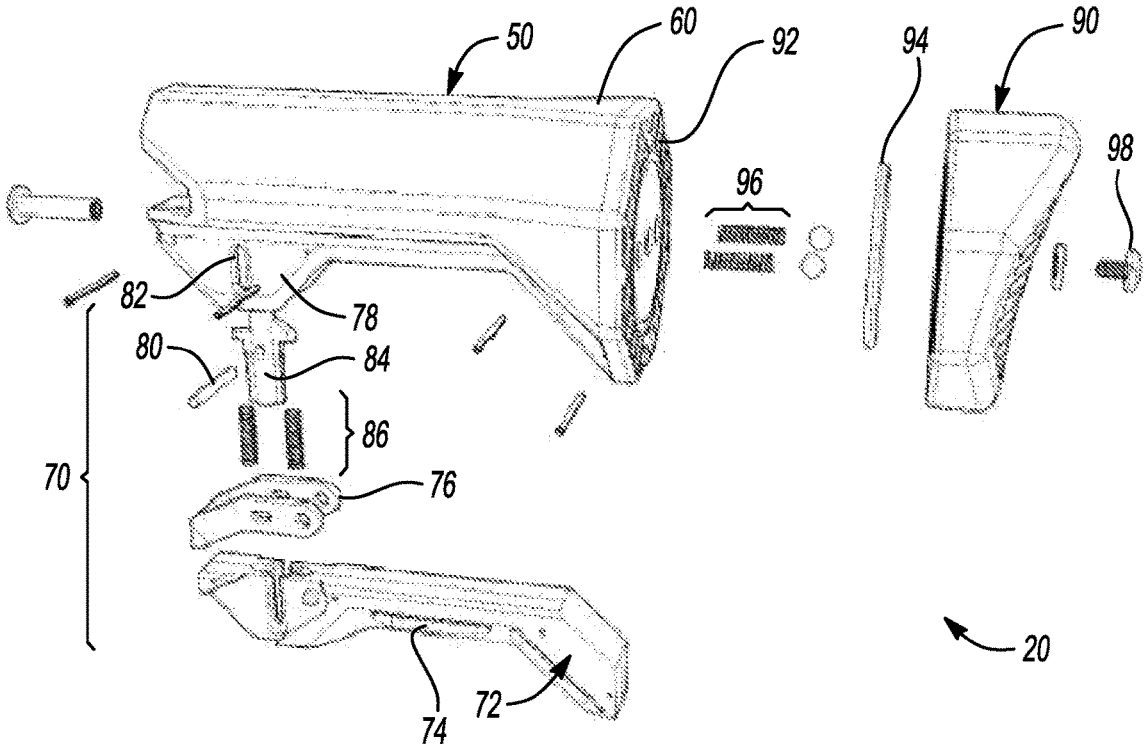
FIG. 4 is an exploded side view of one embodiment of the adjustably positionable firearm stock assembly.

Stock assembly 20 includes a locking mechanism 70 configured to releasably engage a portion of the outer surface 48 of the receiver extension tube 40 to allow the stock assembly 20 to be releasably engaged with the receiver 12 of the firearm 10. As best shown in FIG. 4, the locking mechanism 70 is disposed on a bottom portion 62 of the stock assembly body 50, though it is understood that the locking mechanism may be disposed on other locations of the body 50 while accomplishing the objectives of this disclosure.

Locking mechanism 70 includes a lever or handle 72. Handle 72 may be shaped to align or mate with the shape of the bottom portion 62 of the stock assembly body 50 when the locking mechanism is in a first position, also known as a locked position or engaged position. In one non-limiting example shown in the side view of the stock assembly of FIG. 3, the handle 72 may be at least partially concave shaped and curve inward toward the longitudinal axis 49 of the receiver extension tube 40 to align with the concave shape of the contoured region 68 of the bottom portion 62 of the stock assembly body 50 to accommodate a user's body armor.

In another non-limiting example, the locking mechanism 70 may include one or more triggers or switches to cooperate with elements of the locking mechanism to releasably engage the receiver extension tube 40 of firearm 10. The one or more triggers may include an adjustment trigger and a removal trigger. Both triggers may be orientated in-line with the receiver extension tube 40 and be disposed proximate or inside the body 50 of stock assembly 20. The adjustment trigger may be actuated by sliding it in line with the receiver extension tube 40. The removal trigger may be smaller and intentionally difficult to operate to prevent accidental removal of the rear butt member 90. By orienting the adjustment and removal triggers this way, the overall size of the rear butt member 90 can be smaller, thereby reducing weight, and allow the exterior surface to avoid snagging clothing, gear, or environmental obstructions.

Referring now to FIGS. 2 and 4, one or more apertures 74 may be incorporated in the handle 72 to assist a user in engaging and adjusting the handle 72 of the locking mechanism 70. Handle 72 is movably connected to bracket 76. Bracket 76 cooperates with a receiving surface 78 of the stock assembly body 50. A pin 80 extends at least partially through the bracket 76, receiving surface 78 and one or more holes 82 in the body 50 to allow the locking mechanism 70 to adjust relative to the body between the first or locked position shown in the Figures and a second position, also known as an unlocked position or disengaged position (not shown).

Locking mechanism 70 further includes a latching member 84 that is positionable to secure the stock assembly 20 in a position on the receiving extension tube 40. The latching member 84 may be formed in a variety of geometries or configurations and may be formed to cooperate with a mating recess or surface (not shown) formed on the outer surface 48 of the receiving extension tube 40. The latching member 84 may also be configured to receive pin 80 therethrough.

One or more springs 86 cooperate with a mating recess formed in the handle 72 to bias the latching member 84 between the first position, wherein the latching member 84 engages a portion of the outer surface 48 of the receiver extension tube 40 and a second position, also known as an unlocked or disengaged position, wherein the latching member 84 disengages from the outer surface 48 of the receiver extension tube 40 to position the stock assembly 20 along the longitudinal axis 49 of the receiver extension tube 40 relative to the receiver 12 of firearm 10.

Referring now to FIGS. 3-6, the rear butt pad or member 90 of the stock assembly 20 is discussed in greater detail. The rear end 60 of stock assembly body 50 is provided opposite the forward end 58 on body 50 and may be configured to receive the rear butt member 90. As is shown in FIG. 4, a mounting surface 92 may be provided on the rear end 60 of the stock assembly body 50. The mounting surface 92 may be integrally formed into the rear end 60 of the body 50 or may be formed into a plate or other device configured for securement to the rear end 60. A plate 94 adjustably connects to the mounting surface 92 and cooperates with a housing 100 of the rear butt member 90. The plate may be integrally formed into the rear butt member 90 or may be secured to a portion of the rear butt member 90.

One or more biasing members 96 may be positioned between the mounting surface 92 and plate 94. A fastener 98 may extend at least partially through the rear butt member 90 to releasably engage the mounting surface 92 on the rear end 60 of the stock assembly body 50 to secure the rear butt member 90 in position relative to the body 50. In one non-limiting example, the fastener 98 releasably engages a portion of the mounting surface 92 corresponding to the longitudinal axis 49 of the stock assembly 20.

Referring additionally to FIGS. 2 and 7-8, the rear butt member 90 may be formed in a variety of geometric shapes and configurations to assist a user wearing body armor or bulky garments or wearing broad shoulder straps associated with load bearing gear, such as a backpack, in operating the firearm 10 in a variety of shooting positions, such as a traditional upright shooting position, a combative hunched shooting position, or a prone shooting position.

Figure 5:
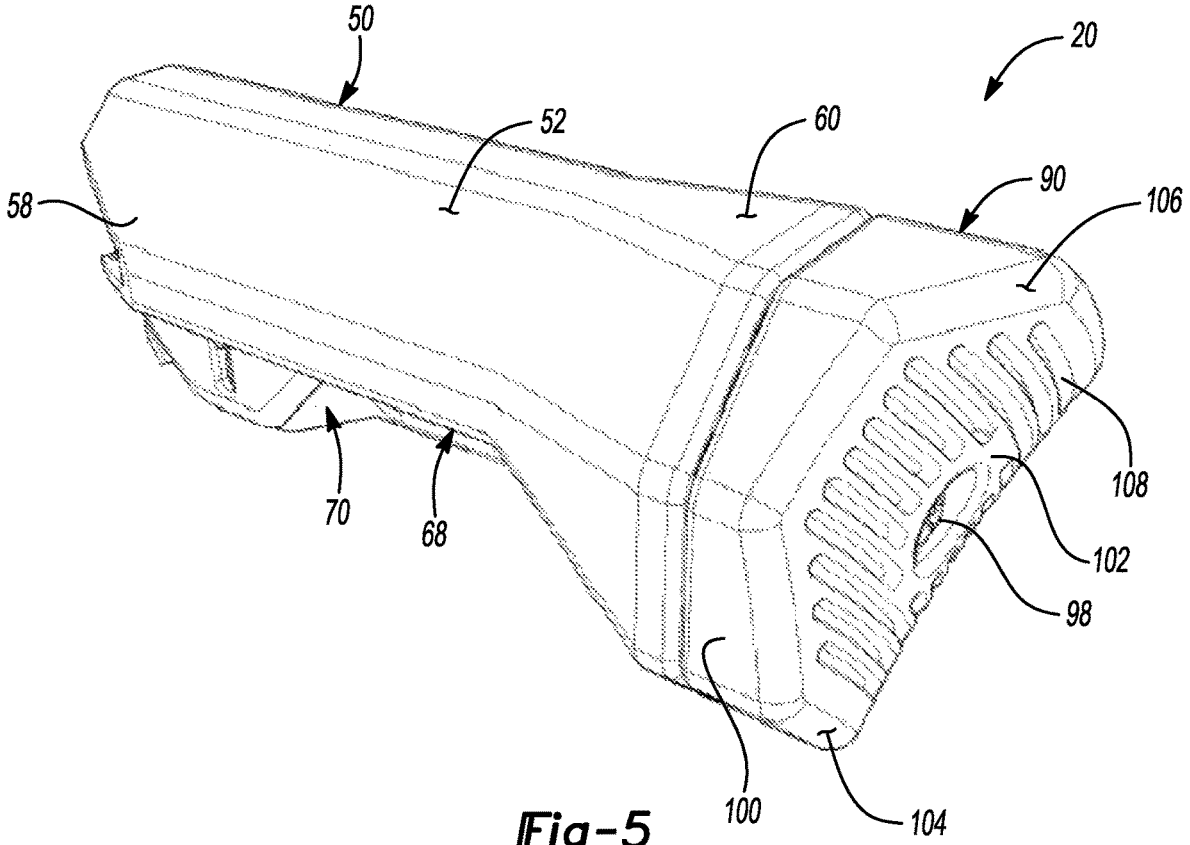
FIG. 5 is a perspective view of one embodiment of the adjustably positionable firearm stock assembly in accordance with embodiments of the disclosure.

In one or more embodiments, the rear butt member 90 includes a housing 100 adjustably positionable up to 360 degrees in rotation relative to the stock assembly body 50 to place the rear butt member 90 in an optimal position for operation of the firearm by the user 200. For example, as shown in FIGS. 5, 7 and 8, the housing 100 of rear butt member 90 defines a user engageable end surface 102. The end surface 102 may be formed with multiple geometries or contours to provide optimal engagement with the stock assembly 20 when the user 200 assumes a shooting position.

In one-non limiting example, the end surface 102 is formed with a first region, also known as a base region 104, and a second region, also known as a contoured region or protruding region 106, extending away from the base region 104 or extending a distance past the base region 104 relative to the stock assembly body 50. In operation, a user 200 engages the firearm 10 to place the stock assembly 20 adjacent the user's shoulder 204. The user is wearing either body armor 202 with a shoulder strap 206 or another garment or accessory, item, such as load bearing gear, with a shoulder strap spaced away from the user's body.

The rear butt member 90 may be adjustably positioned on the stock assembly body 50 such that the base region 104 of the rear butt member 90 is positioned on a surface 206 extending forward of the user's body, such as the shoulder strap 206 of the body armor 202. The geometry or contour of the end surface 102 of the rear butt member 90 places a protruding region 106 proximate the user's body 204, such as proximate the user's shoulder 204. It is contemplated that the protruding region 106 may cooperate or align with a terminal or end surface of the shoulder strap 206, thereby positioning the protruding region 106 proximate the user's shoulder 204 to give the user more control of the firearm for a more desirable user experience.

Figure 6:
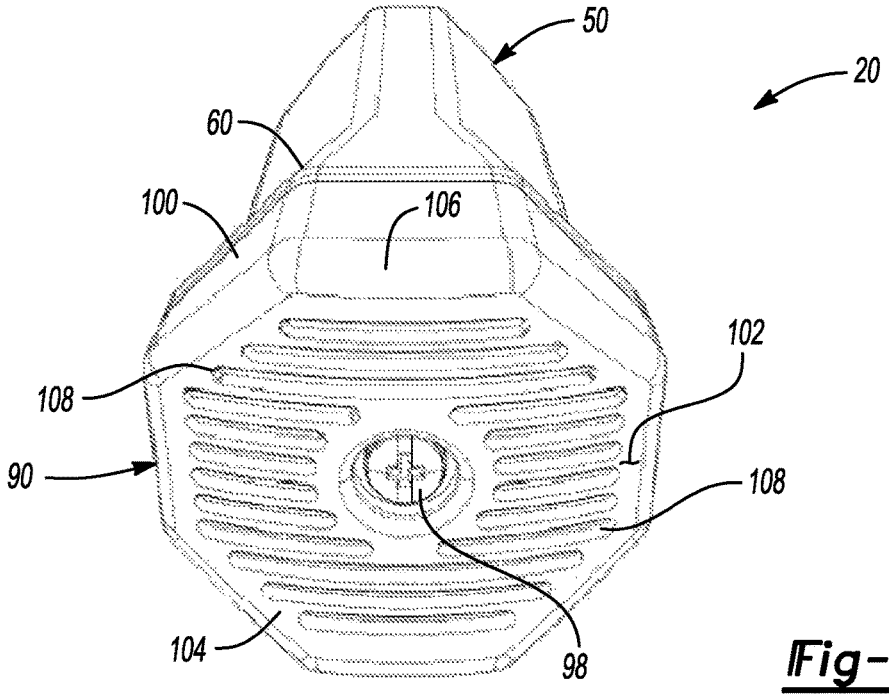
FIG. 6 is a rear end view of the adjustably positionable firearm stock assembly.
Figure 9A:
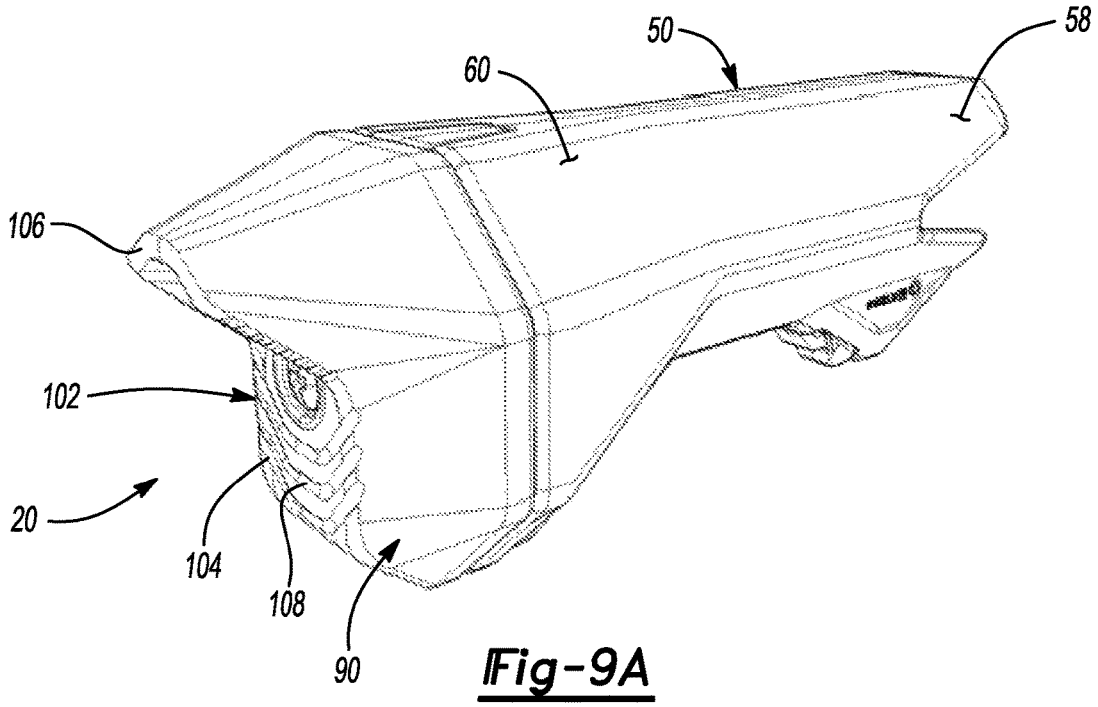
FIG. 9A is a perspective view of another embodiment of an adjustably positionable firearm stock assembly in a first operating position in accordance with embodiments of the disclosure.
Figure 9B:
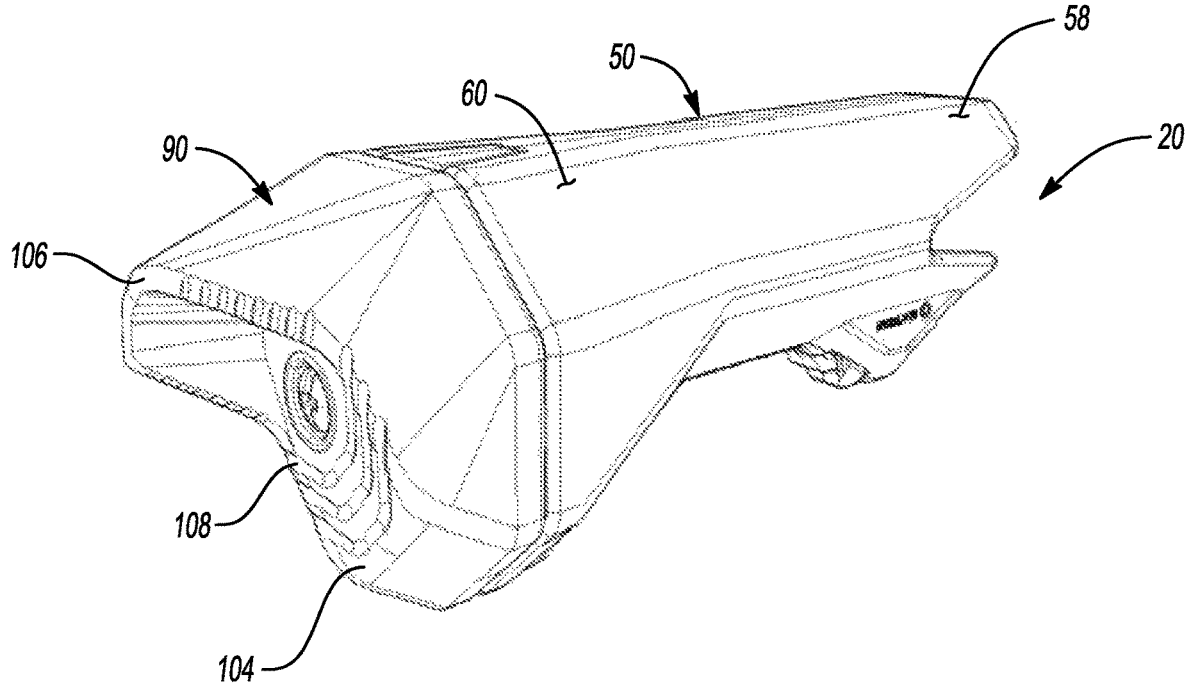
FIG. 9B is a perspective view of the embodiment shown in FIG. 9A with the adjustably positionable firearm stock assembly in a second operating position in accordance with embodiments of the disclosure.

The rear butt member 90 may be formed using a plastic material, polymeric material, a metallic material, a wood material and/or a combination of plastic, polymeric, metallic, and wood materials for functional and aesthetic purposes. The rear butt member 90 may be formed of the same materials as stock assembly body 50 or may utilize distinct materials for each of the rear butt member 90 and stock assembly body 50. Referring now to FIGS. 6 and 9A-9B, the end surface 102 of the housing 100 of the rear butt member 90 may include a plurality of recesses 108 formed therein. The plurality of recesses 108 may be incorporated in the end surface to provide a frictional contact or grip between the end surface 102 and the user 200 to ensure the rear butt member 90 remains in position proximate the user's body during operation of the firearm 10. Alternatively, the plurality of recesses may serve to reduce the amount of material required to form the rear butt member 90, thereby reducing the overall weight of the stock assembly.

The outer periphery 52 of the stock assembly body 50 of the embodiments illustrated in FIGS. 2-8 and FIGS. 9A-9B generally defines a polygonal shape in cross section. In one-non limiting example illustrated in FIGS. 6 and 9A-9B, the rear butt member 90 is octagonal in shape and is formed to match an octagonal shaped stock assembly body 50 extending between the forward end 58 and rear end 60. However, it is understood that a variety of geometric configurations may be used to form the outer periphery of the stock assembly body 50 and the rear butt member 90.

Figure 10:
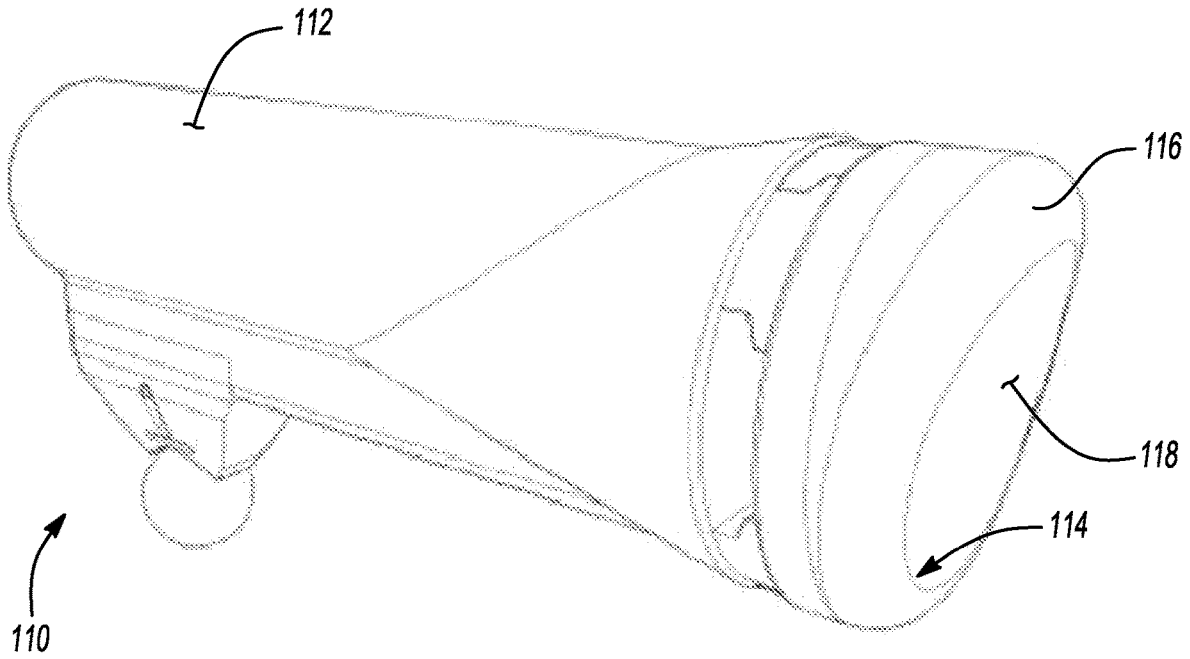
FIG. 10 is a perspective view of another embodiment of an adjustably positionable firearm stock assembly in accordance with embodiments of the disclosure.

FIG. 10 illustrates another embodiment of the stock assembly of the present disclosure. This stock assembly, referenced in FIG. 10 as 110, incorporates similar features to the stock assembly discussed above. Stock assembly 110 includes a generally cylindrical shaped outer periphery 112. Rear butt member 114 is generally circular shaped in cross section to align with the cylindrical shaped outer periphery 112 of the stock assembly 110. The rear butt member 114 includes a protruding region 116 extending from the end surface 118 of the rear butt member 114. The protruding region 116 of the rear butt member 114 may be repositioned by rotating the rear butt member 114 relative to the stock assembly 110.

Figure 11:
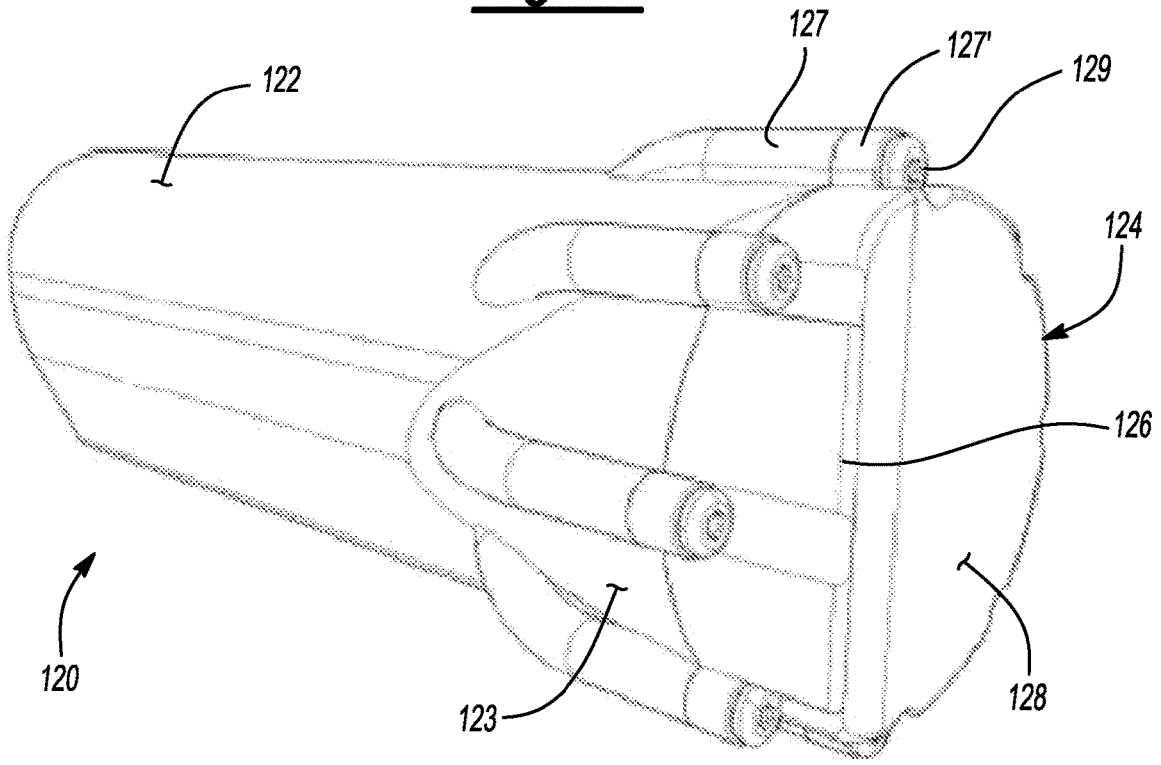
FIG. 11 is a perspective view of yet another embodiment of an adjustably positionable firearm stock assembly in accordance with embodiments of the disclosure.

FIG. 11 illustrates yet another embodiment of the stock assembly of the present disclosure. This stock assembly, referenced in FIG. 11 as 120, incorporates similar features to the stock assembly discussed above. Stock assembly 120 includes a body 122 having an upper portion that is arcuate or semi-circular in cross section that terminates in a generally cylindrical rear end 123. Rear butt member 124 is generally circular shaped in cross section to align with the cylindrical shaped rear end 123 of the stock assembly 120. The rear butt member 124 includes a protruding region 126 extending from the end surface 128 of the rear butt member 124. A series of mating projections 127 extend from each of the stock assembly body 122 and the rear butt member 124. The rear butt member 124 may be repositioned by aligning mating projections 127' on the rear butt member 124 with mating projections 127 on the stock assembly body 122 and securing the mating projections 127, 127' with a plurality of fasteners 129.

Figure 12:
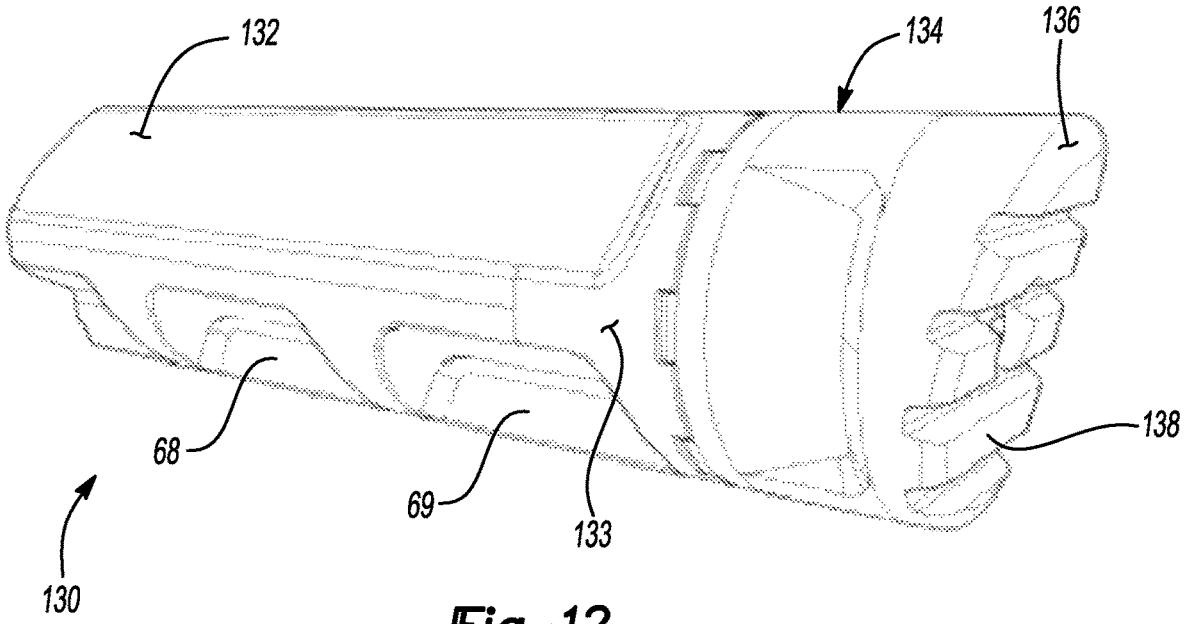
FIG. 12 is a perspective view of still another embodiment of an adjustably positionable firearm stock assembly in accordance with embodiments of the disclosure.

FIG. 12 illustrates still another embodiment of the stock assembly of the present disclosure. This stock assembly, referenced in FIG. 12 as 130, incorporates similar features to the stock assembly discussed above. Stock assembly 130 includes a hexagonal shaped body 132 in cross section that terminates in a generally cylindrical rear end 133. Rear butt member 134 is generally circular shaped in cross section to align with the cylindrical shaped rear end 133 of the stock assembly 130. The rear butt member 134 includes a protruding region 136 extending from the end surface 138 of the rear butt member 134. The protruding region 136 of the rear butt member 134 may be repositioned by rotating the rear butt member 134 relative to the stock assembly 130.

Referring now to FIGS. 13A-18B, additional embodiments of the stock assembly in accordance with the present disclosure are detailed. This stock assembly, referenced in these Figures generally by number 140, incorporates similar features to the stock assembly discussed above. Stock assembly 140 includes a body 142 defining an outer periphery 144 and an inner periphery 146. The stock assembly body 142 may be formed using a plastic material, polymeric material, a metallic material, a wood material and/or a combination of plastic, polymeric, metallic, and wood materials for functional and aesthetic purposes.

The inner periphery 146 may include at least one channel 148 defined in a forward end 150 of the body 142. The at least one channel 148 of the inner periphery 146 may be configured to receive and releasably engage a portion of an outer surface 48 of a receiver extension tube 40 and allow the stock assembly 140 to be adjustably positionable on the receiver extension tube 40. The rear end 152 of body 142 is provided opposite the forward end 150 on body 142 and may be configured to receive a rear butt pad or member 154. A locking mechanism 156 is configured to releasably engage a portion of the outer surface 48 of the receiver extension tube 40 to allow the stock assembly 140 to be adjustably positioned relative to the receiver 12 of the firearm 10.

Figure 13A:
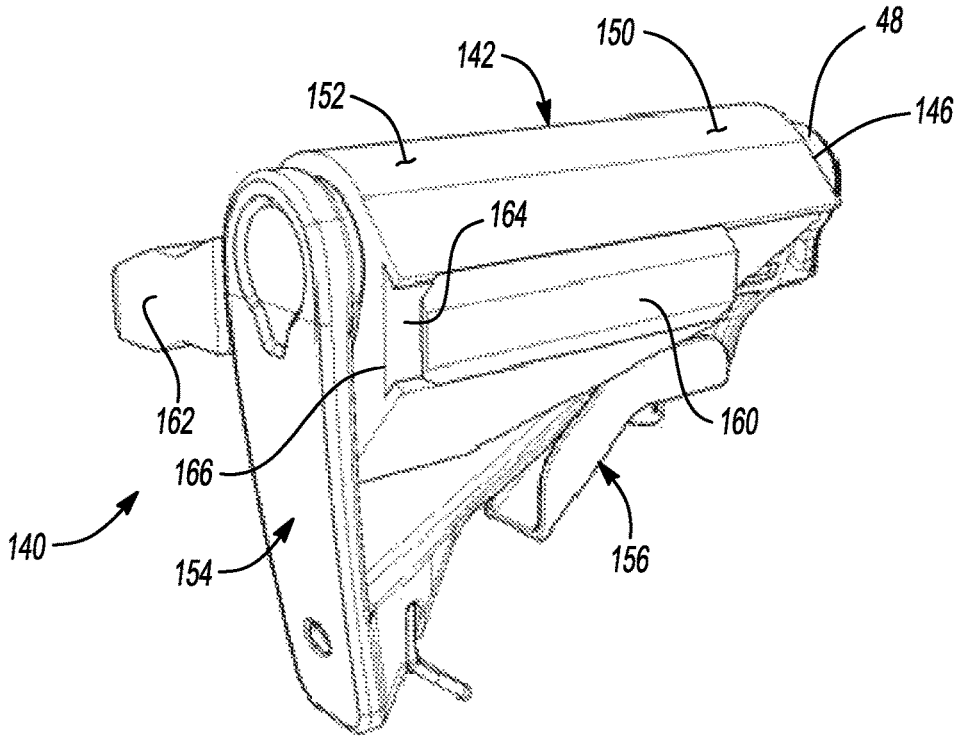
FIG. 13A is a perspective view of yet another embodiment of an adjustably positionable firearm stock assembly in a first operating position in accordance with embodiments of the disclosure.
Figure 13B:
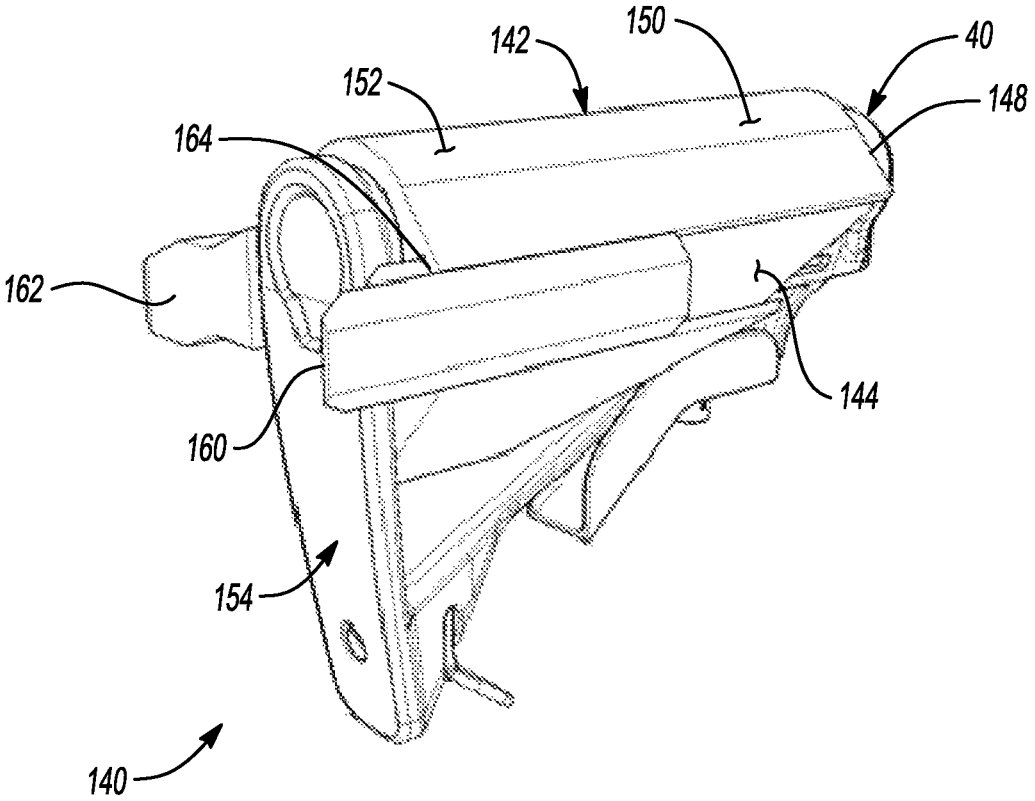
FIG. 13B is a perspective view of the embodiment shown in FIG. 13A with the adjustably positionable firearm stock assembly in a second operating position in accordance with embodiments of the disclosure.

FIGS. 13A-13B illustrate one embodiment of the stock assembly of the present disclosure. Stock assembly 140 may include one or more adjustably positionable arms 160, 162 disposed on opposing sides of the outer periphery 144 of the stock assembly body 142. In one non-limiting example, each of the opposing sides of the stock assembly body 142 includes at least one channel 164 formed in the outer periphery 144 of the body 142. Channel 164 includes an end 166 disposed proximate the rear end 152 of the body 142. Amis 160, 162 are sized to include a portion received within and at least partially engaging the channel 164.

Arms 160, 162 may be adjustably positioned between a first position shown in FIG. 13A, also known as a stored position, and a second position shown in FIG. 13B, also known as a deployed position. In the first position or stored position illustrated in FIG. 13A, the arms 160, 162 are positioned proximate the outer periphery 144 of the stock assembly body 142 such that no portion of the arms 160, 162 extends rearward of the rear end 152 of the body 142 and rear butt member 154. In the second position or deployed position shown in FIG. 13B, at least one of the arms 160 is adjustably positioned through the channel 164 to extend rearward of the rear end 152 of the body 142 and the rear butt member 154 to position a portion of arm adjacent a terminal or end surface of a shoulder strap of body armor or the like, thereby positioning the arm 160 proximate a user's shoulder in the operating position of a firearm.

Figure 14A:
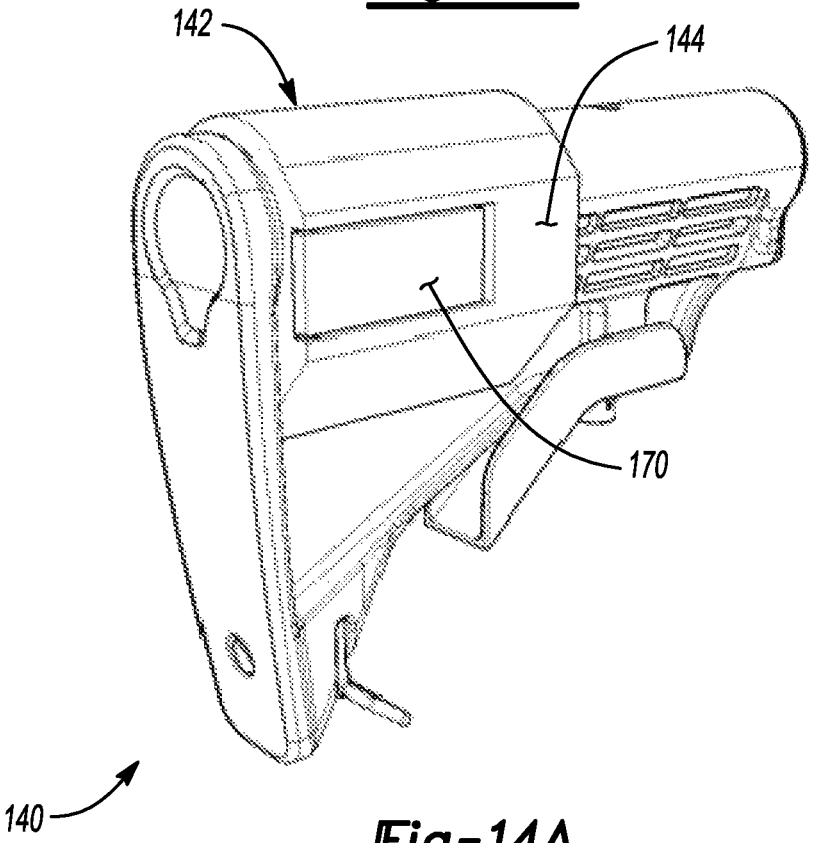
FIG. 14A is a perspective view of still another embodiment of an adjustably positionable firearm stock assembly in a first operating position in accordance with embodiments of the disclosure.
Figure 14B:
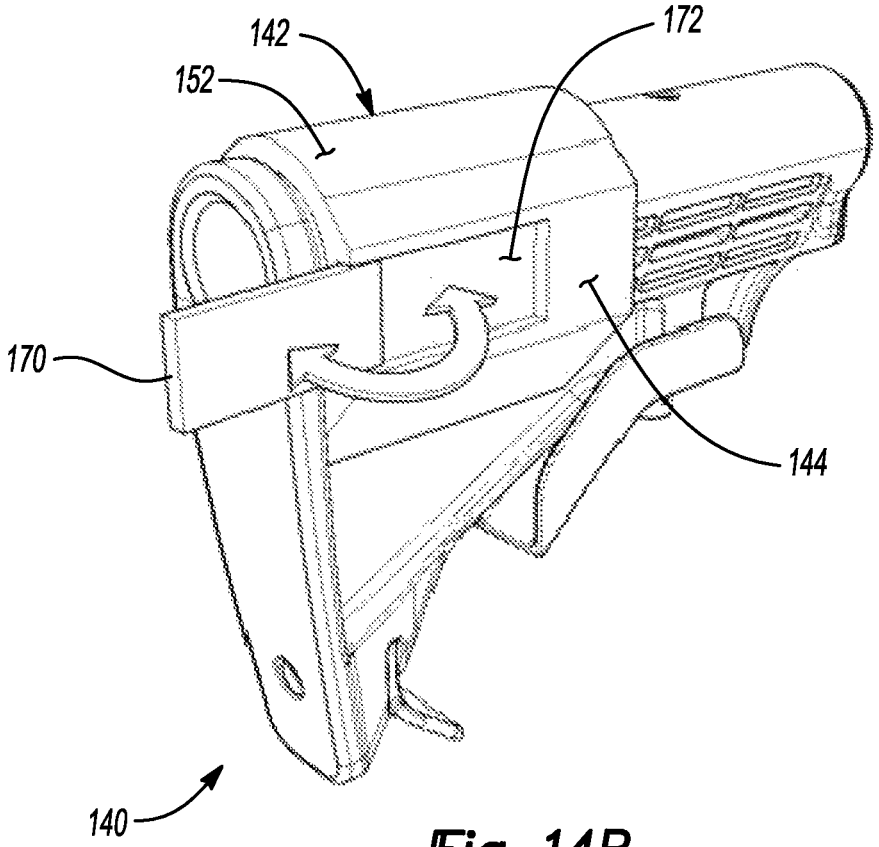
FIG. 14B is a perspective view of the embodiment shown in FIG. 14A with the adjustably positionable firearm stock assembly in a second operating position in accordance with embodiments of the disclosure.

FIGS. 14A-14B illustrate another embodiment of the stock assembly of the present disclosure. Stock assembly 140 may include one or more adjustably positionable arms 170 disposed on opposing sides of the outer periphery 144 of the stock assembly body 142. In one non-limiting example, each of the opposing sides of the stock assembly body 142 includes at least one recess 172 formed in the outer periphery 144 of the body 142 disposed proximate the rear end of the body 142 that is sized to receive the arm 170 within the recess 172 when the arm 170 is in the first position or stored position.

Arms 170 may be adjustably positioned between a first position shown in FIG. 14A, also known as a stored position, and a second position shown in FIG. 14B, also known as a deployed position. In the first position or stored position illustrated in FIG. 13A, the one or more arms 170 are received within the recess 172 such that the arm and outer periphery 144 of the stock assembly body 142 such that no portion of the one or more arms 170 extends rearward of the rear end 152 of the body 142 and rear butt member 154. In the second position or deployed position shown in FIG. 14B, the one or more arms 170 are pivotally connected to the body 142 such that the arms are rotated to extend rearward of the rear end 152 of the body 142 and the rear butt member 154 to position a portion of arm 170 adjacent a terminal or end surface of a shoulder strap of body armor or the like, thereby positioning the arm 170 proximate a user's shoulder in the operating position of a firearm.

Figure 15A:
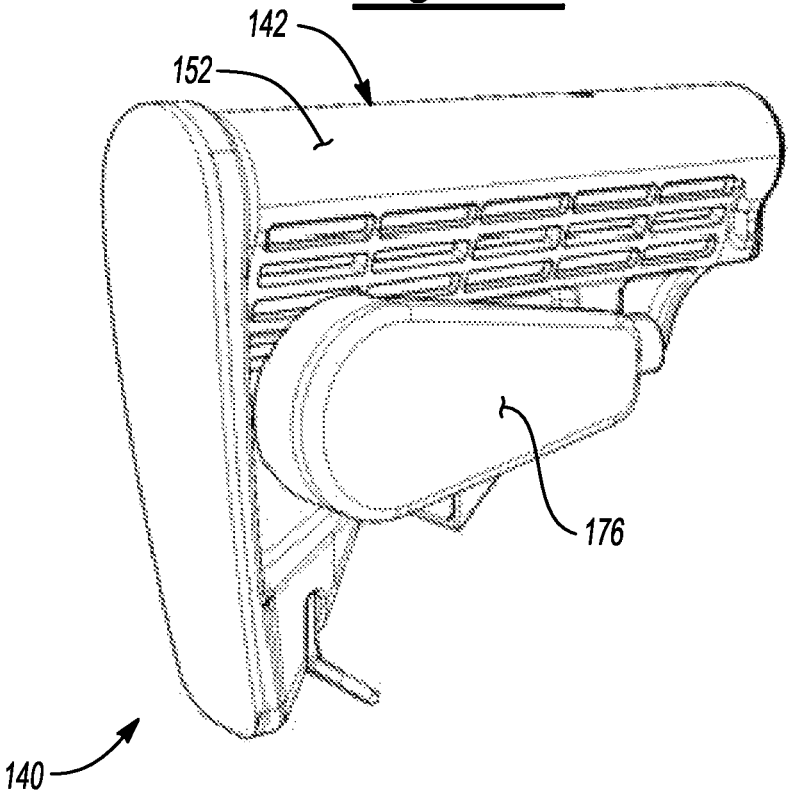
FIG. 15A is a perspective view of another embodiment of an adjustably positionable firearm stock assembly in a first operating position in accordance with embodiments of the disclosure.
Figure 15B:
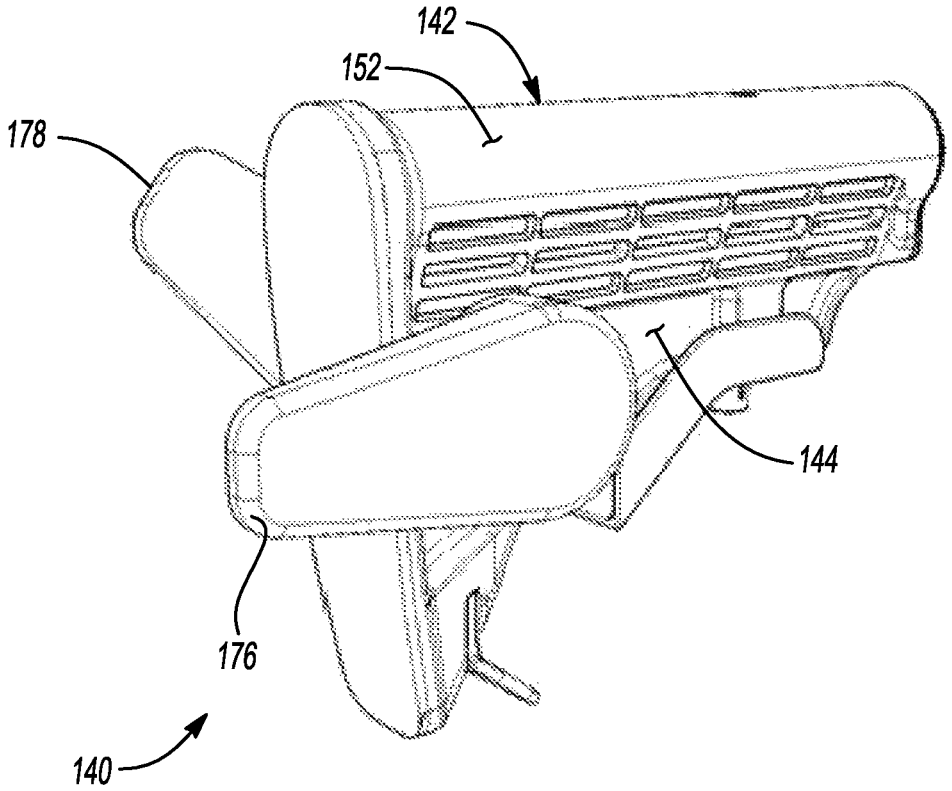
FIG. 15B is a perspective view of the embodiment shown in FIG. 15A with the adjustably positionable firearm stock assembly in a second operating position in accordance with embodiments of the disclosure.

FIGS. 15A-15B illustrate another embodiment of the stock assembly of the present disclosure. Stock assembly 140 may include one or more adjustably positionable arms 176, 178 disposed on and rotatably connected to opposing sides of the outer periphery 144 of the stock assembly body 142. Arms 176, 178 may be adjustably positioned between a first position shown in FIG. 15A, also known as a stored position, and a second position shown in FIG. 15B, also known as a deployed position.

In the first position or stored position illustrated in FIG. 15A, arms 176, 178 are positioned proximate the outer periphery 144 of the stock assembly body 142 such that no portion of the arms 176, 178 extends rearward of the rear end 152 of the body 142. In the second position or deployed position shown in FIG. 15B, the one or more arms 176, 178 are pivotally connected to the body 142 such that the arms are rotated to extend rearward of the rear end 152 of the body 142 and the rear butt member 154 to position a portion of arm adjacent a terminal or end surface of a shoulder strap of body armor or the like, thereby positioning the arms 176, 178 proximate a user's shoulder in the operating position of a firearm.

Figure 16A:
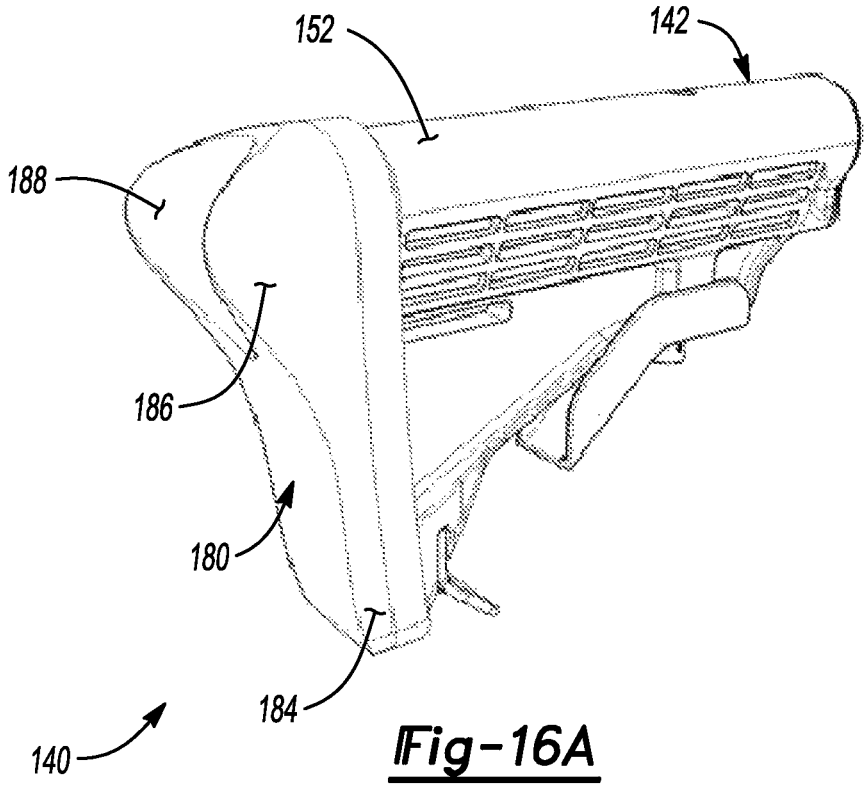
FIG. 16A is a perspective view of yet another embodiment of an adjustably positionable firearm stock assembly in a first operating position in accordance with embodiments of the disclosure.
Figure 16B:
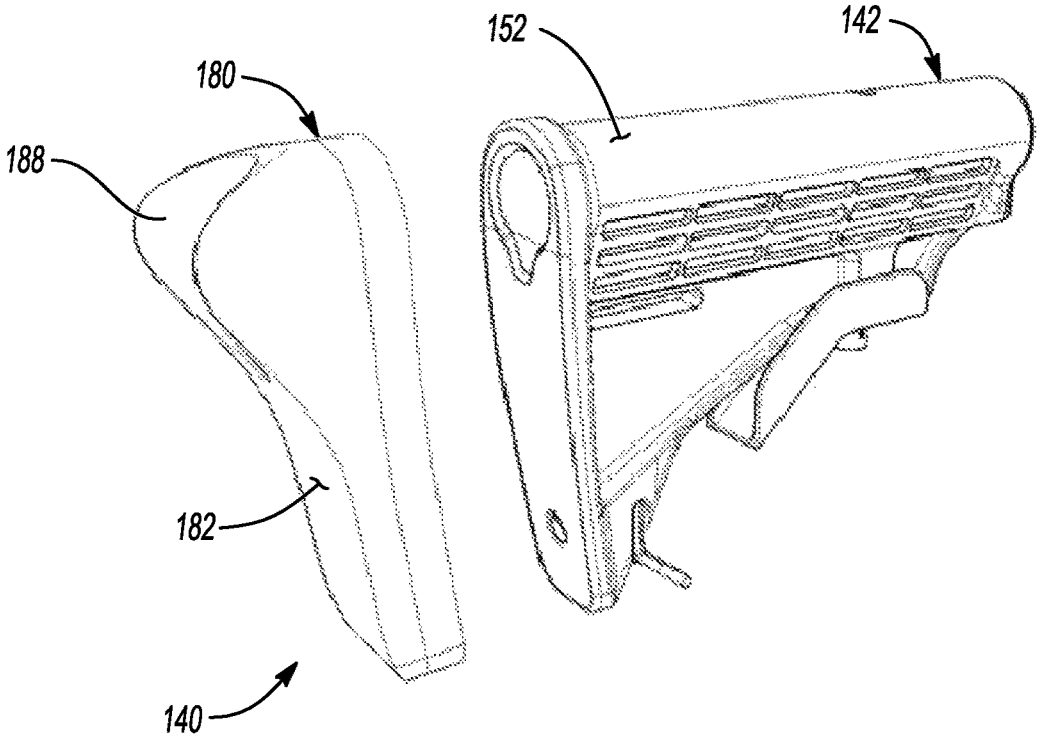
FIG. 16B is a perspective view of the embodiment shown in FIG. 16A with the adjustably positionable firearm stock assembly in a second operating position in accordance with embodiments of the disclosure.
Figure 17A:
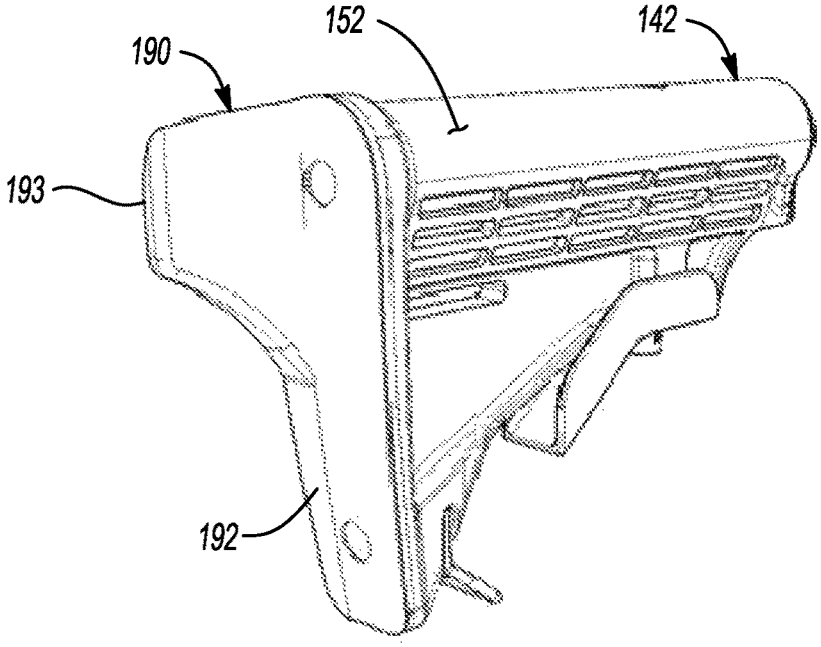
FIG. 17A is a perspective view of still another embodiment of an adjustably positionable firearm stock assembly in a first operating position in accordance with embodiments of the disclosure.
Figure 17B:
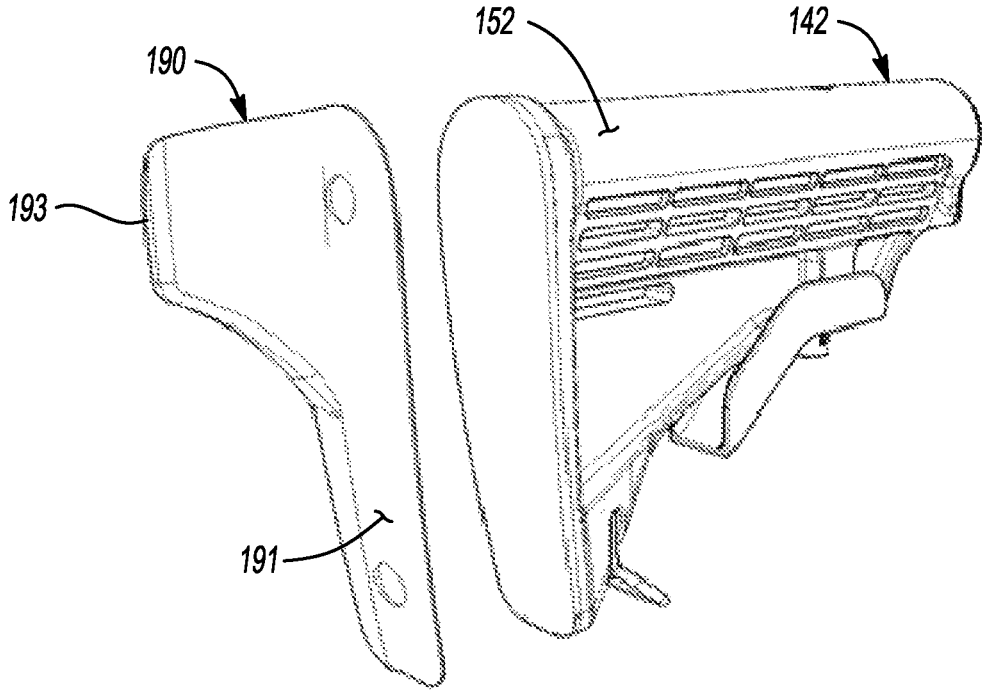
FIG. 17B is a perspective view of the embodiment shown in FIG. 17A with the adjustably positionable firearm stock assembly in a second operating position in accordance with embodiments of the disclosure.
Figure 18A:
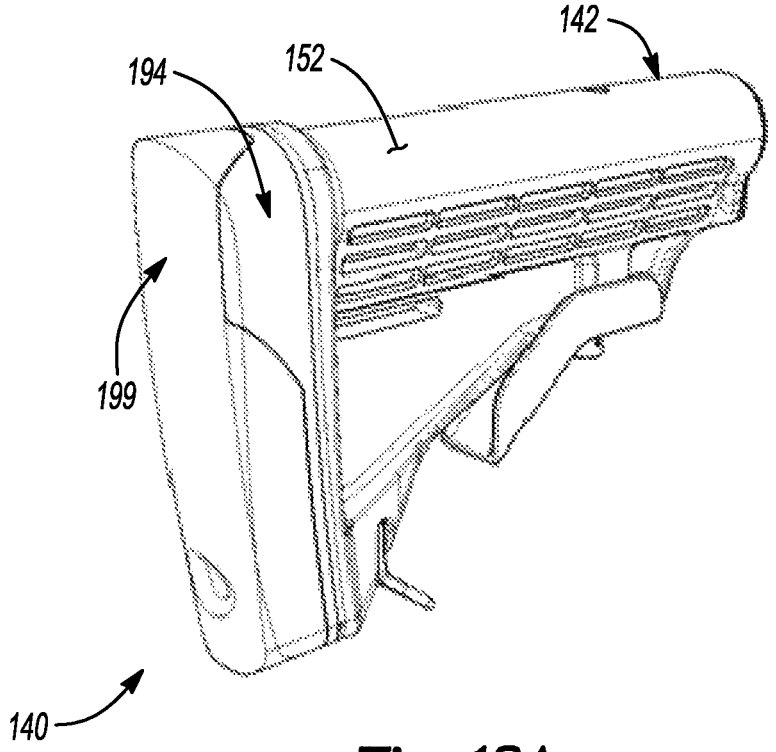
FIG. 18A is a perspective view of another embodiment of an adjustably positionable firearm stock assembly in a first operating position in accordance with embodiments of the disclosure.
Figure 18B:
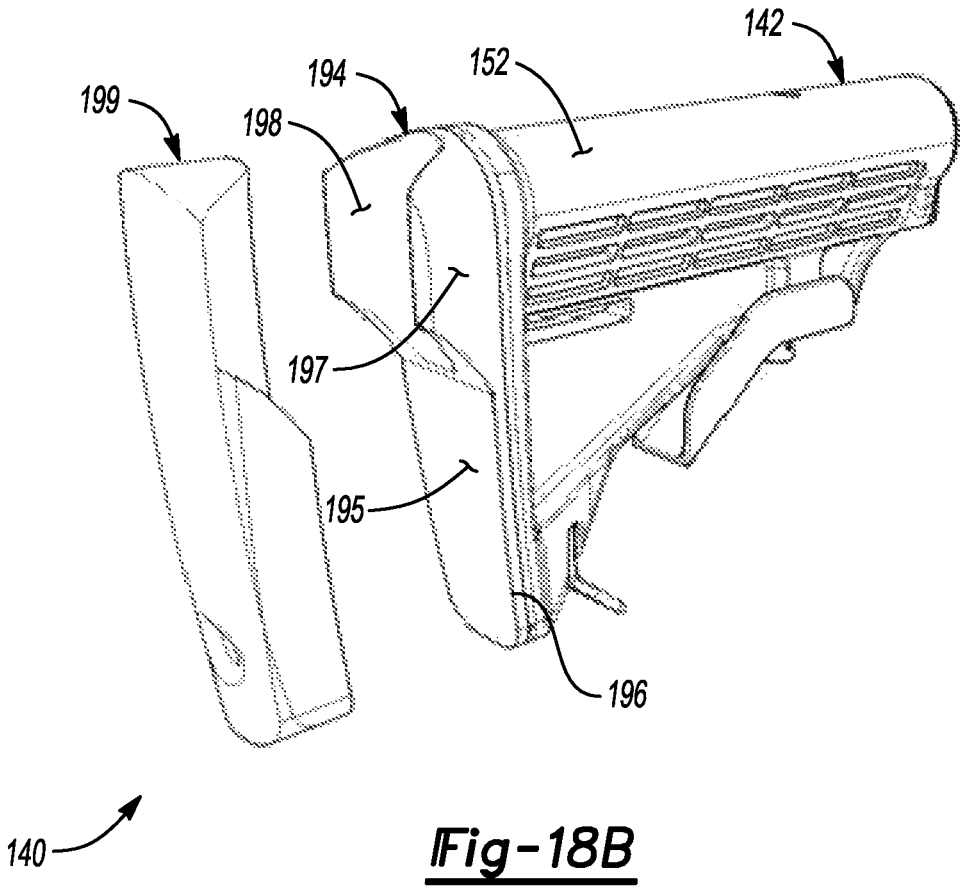
FIG. 18B is a perspective view of the embodiment shown in FIG. 18A with the adjustably positionable firearm stock assembly in a second operating position in accordance with embodiments of the disclosure.

Referring additionally now to FIGS. 16A-18B, additional embodiments of the stock assembly in accordance with the present disclosure are detailed. FIGS. 16A, 17A and 18A each illustrate a rear butt member in an engaged position proximate the rear end 152 of the body 142 of the stock assembly 140, while FIGS. 16B, 17B and 18B illustrate the rear butt member disengaged from the rear end 152 of the stock assembly body 142. As described above and illustrated in at least FIG. 13*a*, the rear butt member 154 may be formed using a plastic material, polymeric material, a metallic material, a wood material and/or a combination of plastic, polymeric, metallic, and wood materials for functional and aesthetic purposes. The rear butt member 154 may be formed of the same materials as stock assembly body 142 or may utilize distinct materials for each of the rear butt member 154 and stock assembly body 142.

Referring now to FIGS. 16A-16B, the rear butt member 180 includes a user engageable end surface 182. The end surface 182 may be formed with multiple geometries or contours to provide optimal engagement with the stock assembly when the user assumes a shooting position. The end surface 182 is formed with a first region 184 and a second region, also known as a contoured region or protruding region 186 extending a distance past the first region 184 relative to the stock assembly body 142.

The protruding region 186 includes a contoured recess 188 formed therein. The contoured recess 188 may be at least partially concave shaped such that the contoured recess 188 curves inward toward the rear end 152 of body 142. However, it is understood that other geometries and configurations may be utilized for the contoured recess. In operation, the geometry of the contoured recess 188 of the rear butt member 180 places the contoured recess 188 adjacent a terminal or end surface of a shoulder strap of a user, thereby positioning the protruding region 186 proximate the user's shoulder.

Referring now to FIGS. 17A-17B, a rear butt member 190 is disposed proximate the rear end 152 of the stock assembly body 142. Rear butt member 190 includes a user engageable end surface 191. The end surface 191 may be formed with multiple geometries or contours to provide optimal engagement with the stock assembly when the user assumes a shooting position. The end surface 191 is formed with a first region 192 and a second region, also known as a contoured region or protruding region 193 extending a distance past the first region 192 relative to the stock assembly body 142. In operation, the geometry of the protruding region 193 of the rear butt member 190 places the first region 192 adjacent a terminal or end surface of a shoulder strap of a user, thereby positioning the protruding region 193 proximate the user's shoulder.

Referring now to FIGS. 18A-18B, the rear butt member 194 includes a user engageable end surface 195. The end surface 195 may be formed with multiple geometries or contours to provide optimal engagement with the stock assembly when the user assumes a shooting position. The end surface 195 is formed with a first region 196 and a second region, also known as a contoured region or protruding region 197 extending a distance past the first region 196 relative to the stock assembly body 142.

The protruding region 197 includes a contoured recess 198 formed therein. The contoured recess 198 may be at least partially concave shaped such that the contoured recess 198 curves inward toward the rear end 152 of body 142. However, it is understood that other geometries and configurations may be utilized for the contoured recess. In operation, the geometry of the contoured recess 198 of the rear butt member 194 places the contoured recess 198 adjacent a terminal or end surface of a shoulder strap of a user, thereby positioning the protruding region 197 proximate the user's shoulder.

FIG. 18B illustrates a rear butt member mating portion 199. The rear butt member mating portion 199 includes an opposing geometry to the first region 196, protruding region 197 and contoured recess 198, such that, when the rear butt member mating portion 199 is brought into alignment with the end surface 195 of the rear butt member 194, the rear butt mating portion 199 releasably engages and may be secured to the end surface 195 of the rear butt member 194.

The foregoing specification has been described with reference to various embodiments. Various operational steps, as well as components for carrying out operational steps, may be implemented in alternate ways depending upon the application or in consideration of several cost functions associated with the operation of the system. For example, one or more of the steps may be deleted, modified, or combined with other steps. Further, this disclosure is to be regarded in an illustrative rather than a restrictive sense, and the modifications are intended to be included within the scope thereof.

As used herein, the terms "comprises" and "includes," and other variations thereof, are intended to cover a non-exclusive inclusion, such that a process, a method, an article, or an apparatus that comprises a list of elements includes those elements and may include other elements not expressly listed or inherent to such process, method, system, article, or apparatus. Also, as used herein, the terms "coupled," "coupling," and other variations thereof are intended to cover a physical connection, an electrical connection, a magnetic connection, an optical connection, a communicative connection, a functional connection, and/or other connection.

The detailed description and the drawings or figures are supportive and descriptive of the disclosure, but the scope of the disclosure is defined solely by the claims. While some of the best modes and other embodiments for carrying out the claimed disclosure have been described in detail, various alternative designs and embodiments exist for practicing the disclosure defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment may be combined with one or a plurality of other desired characteristics from other embodiments, resulting in other embodiments not described in words or by reference to the drawings. Accordingly, such other embodiments fall within the framework of the scope of the appended claims.

The invention claimed is:

1. A firearm comprising:

a receiver;

a barrel assembly connected to a forward end of the receiver;

a receiver extension tube connected to a rear end of the receiver; and a stock assembly releasably engaging the receiver extension tube, the stock assembly including:

a stock assembly body having a forward end, an opposing rear end, and a bottom portion defined between the forward end and rear end, a locking mechanism disposed on the stock assembly body and configured to releasably engage a portion of an outer surface of the receiver extension tube, and a rear butt member adjustably positionable on the rear end of the stock assembly body, wherein the rear butt member includes a housing defining an end surface forming a base region and a protruding region extending from the base region, wherein the rear butt member is adjustably positionable relative to the stock assembly body to position the rear butt member protruding region in an operating position for the firearm.

2. The firearm of claim 1 wherein the stock assembly body further comprises an outer periphery and an inner periphery having at least one channel configured to receive and releasably engage a portion of an outer surface of the receiver extension tube, wherein the stock assembly is adjustably positionable axially along a longitudinal axis of the receiver extension tube.

3. The firearm of claim 1 wherein the bottom portion of the stock assembly body further comprises a first region disposed adjacent the forward end of the body, an opposing second region disposed adjacent to and terminating at the rear end of the body, and a contoured region formed between the first portion and second portion of the body, wherein the contoured region is a recessed area formed in the bottom portion of the body that is sized to accommodate an external accessory of the user.

4. The firearm of claim 3 wherein the contoured region of the bottom portion of the stock assembly body is at least partially concave shaped relative to the first region and the second region inward toward the longitudinal axis of the receiver extension tube.

5. The firearm of claim 1 wherein the locking mechanism further comprises:

a bracket cooperating with a receiving surface of the stock assembly body;

a handle movably connected to the bracket, wherein the handle includes a mating recess receiving one or more springs therein;

a latching member received in the mating recess of the handle and extending through the bracket into the inner periphery of the stock assembly body, wherein the latching member is positionable between the first position to releasably engage the outer surface of the receiver extension tube and a second position wherein the latching member disengages the outer surface of the receiver extension tube to position the stock assembly along the longitudinal axis of the receiver extension tube.

6. The firearm of claim 5 wherein the handle is shaped to align with the shape of the bottom portion of the stock assembly body and includes one or more apertures formed therein.

7. The firearm of claim 1 further comprising a mounting surface provided on the rear end of the stock assembly body and a plate cooperating with the housing of the rear butt member adjustably connected to the mounting surface, wherein the mounting surface and plate cooperate to adjustably position the rear butt member to the stock assembly body.

8. The firearm of claim 1 further comprising a plurality of recesses formed in the end surface of the housing of the rear butt member.

9. A stock assembly for use with a firearm comprising:

a stock assembly body having a forward end, an opposing rear end, and a bottom portion defined between the forward end and rear end, wherein the bottom portion of the stock assembly body includes a first region disposed adjacent the forward end of the body, an opposing second region disposed adjacent to and terminating at the rear end of the body, and a contoured region formed between the first portion and second portion of the body;

a locking mechanism disposed on the stock assembly body, the locking mechanism configured to releasably engage a portion of an outer surface of a receiver extension tube of the firearm; and a rear butt member adjustably positionable on the rear end of the stock assembly body, wherein the rear butt member includes a housing defining an end surface forming a base region and a protruding region extending from the base region, wherein the rear butt member is adjustably positionable relative to the stock assembly body to position the rear butt member protruding region in an operating position for the firearm.

10. The stock assembly of claim 9 wherein the stock assembly body further comprises an outer periphery and an inner periphery having at least one channel configured to receive and releasably engage a portion of an outer surface of the receiver extension tube of the firearm, wherein the stock assembly is adjustably positionable axially along a longitudinal axis of the receiver extension tube.

11. The stock assembly of claim 9 wherein the bottom portion of the stock assembly body further comprises a first region disposed adjacent the forward end of the body, an opposing second region disposed adjacent to and terminating at the rear end of the body, and a contoured region formed between the first portion and second portion of the body, wherein the contoured region is a recessed area formed in the bottom portion of the body that is sized to accommodate an external accessory of the user.

12. The stock assembly of claim 11 wherein the contoured region of the bottom portion of the stock assembly body is at least partially concave shaped relative to the first region and the second region inward toward the longitudinal axis of the receiver extension tube.

13. The stock assembly of claim 9 wherein the locking mechanism further comprises:

a bracket cooperating with a receiving surface of the stock assembly body;

a handle movably connected to the bracket, wherein the handle includes a mating recess receiving one or more springs therein;

a latching member received in the mating recess of the handle and extending through the bracket into the inner periphery of the stock assembly body, wherein the latching member is positionable between the first position to releasably engage the outer surface of the receiver extension tube and a second position wherein the latching member disengages the outer surface of the receiver extension tube to position the stock assembly along the longitudinal axis of the receiver extension tube.

14. The stock assembly of claim 13 wherein the handle is shaped to align with the shape of the bottom portion of the stock assembly body and includes one or more apertures formed therein.

15. The stock assembly of claim 9 further comprising a mounting surface provided on the rear end of the stock assembly body and a plate cooperating with the housing of the rear butt member adjustably connected to the mounting surface, wherein the mounting surface and plate cooperate to adjustably position the rear butt member to the stock assembly body.

16. The stock assembly of claim 9 further comprising a plurality of recesses formed in the end surface of the housing of the rear butt member.

* * * * *